US010694796B2

(12) United States Patent
Samra

(10) Patent No.: US 10,694,796 B2
(45) Date of Patent: Jun. 30, 2020

(54) MODULAR TIE-MAKING DEVICE

(71) Applicant: Gregory Samra, Cambridge, MA (US)

(72) Inventor: Gregory Samra, Cambridge, MA (US)

( * ) Notice: Subject to any disclaimer, the term of this patent is extended or adjusted under 35 U.S.C. 154(b) by 125 days.

(21) Appl. No.: 16/043,291

(22) Filed: Jul. 24, 2018

(65) Prior Publication Data

US 2019/0029343 A1 Jan. 31, 2019

Related U.S. Application Data

(60) Provisional application No. 62/536,745, filed on Jul. 25, 2017.

(51) Int. Cl.
*A41D 25/08* (2006.01)

(52) U.S. Cl.
CPC ..... *A41D 25/08* (2013.01)

(58) Field of Classification Search
CPC .... A41D 25/025; A41D 25/027; A41D 25/08; A41D 25/10
See application file for complete search history.

(56) References Cited

U.S. PATENT DOCUMENTS 4,573,219 A * 3/1986 Hooten ..... A41D 25/022 2/153
5,170,507 A * 12/1992 Langford ..... A41D 25/008 2/148
5,218,722 A * 6/1993 Vandenberg ..... A41D 25/025 2/152.1
D352,376 S * 11/1994 Moore ..... D2/605
5,577,778 A * 11/1996 Parietti ..... A41D 25/08 2/148
5,692,241 A * 12/1997 Helfer ..... A41D 25/08 2/148
6,920,642 B2 * 7/2005 Dickens ..... A41D 25/022 2/152.1
8,931,116 B2 * 1/2015 Lucero ..... A41D 25/022 2/137
D805,270 S * 12/2017 Lucero ..... D2/609
2005/0120461 A1 * 6/2005 Dickens ..... A41D 25/022 2/144
2012/0185995 A1 * 7/2012 Fear ..... A41D 25/025 2/152.1

* cited by examiner

*Primary Examiner* — Shaun R Hurley
(74) *Attorney, Agent, or Firm* — Chan Hubbard PLLC; Keala Chan

(57) ABSTRACT

A modular tie-making device that is made of a tie-knot shaped manifold, the manifold capable of accepting a tie-knot fabric on the outside, and at the same time facilitating a tie to be guided through the manifold, resulting in a modular and fully personalizable tie. The device can be used to make two-toned ties or any combination of tie-knot and tie. The manifold is made of three tubes joined together at their ends. By following the geometry of the manifold, a user easily forms the two loops and hanging ends of a necktie.

20 Claims, 8 Drawing Sheets

MODULAR TIE-MAKING DEVICE

CROSS-REFERENCE TO RELATED APPLICATIONS

This application claims priority to U.S. Provisional Appl. No. 62/536,745, filed on Jul. 25, 2017.

FIELD OF THE INVENTION

The invention lies in the field of men's clothing accessories, in particular tie accessories.

BACKGROUND

Men's neckties are a well-known, infinitely personalizable accessory. In addition to the diversity of colors, prints, materials, and sizes, men's neckties can be tied or knotted in a wide variety of styles. Two-toned ties are a variety of men's necktie in which the knot of the necktie is a different color than the rest of the cloth. Two-toned ties are typically created by sewing together two different ties into a single piece of fabric, and subsequently following the steps to tie the tie around the neck so that the tie knot looks distinct from the hanging ends. Some are sold pre-sewn off-the-shelf, but most are created by users in a DIY fashion.

SUMMARY OF THE INVENTION

It is an object of the present invention to provide a device for easy construction of a personalized, two-toned tie. It is another object of the present invention to present a modular device that facilitates interchangeability between multiple neckties. It is yet another object of the present invention to facilitate personal expression, such that a wearer may select knots of different colors, fabrics, shapes, and knots patterns to permute different style combinations between the full-length necktie and the knot itself. This includes, but is not limited to, "two-tone" ties of any two chosen colors. It is another object of the present invention that the device is easy to use by any user, regardless of whether they know how to tie a necktie knot, especially non-traditional necktie knots.

The present invention is a device comprised of three interlocking tubes which are arranged to provide a tie knot-shaped base; said base facilitates creation of a simulated tie knot by allowing the user to thread a necktie through the device and create a de facto tied necktie which can be easily created and worn. The device provides a modular tie option to the wearer, in that once the tie knot has been created, a wide variety of ties can be mixed and matched to wear with the tie knot. The wearer can interchange multiple knots of differing styles with any hanging tie. Thus, the invention is a simple solution to creating a variety of one-toned and two-toned ties.

DETAILED DESCRIPTION

Figure 1:
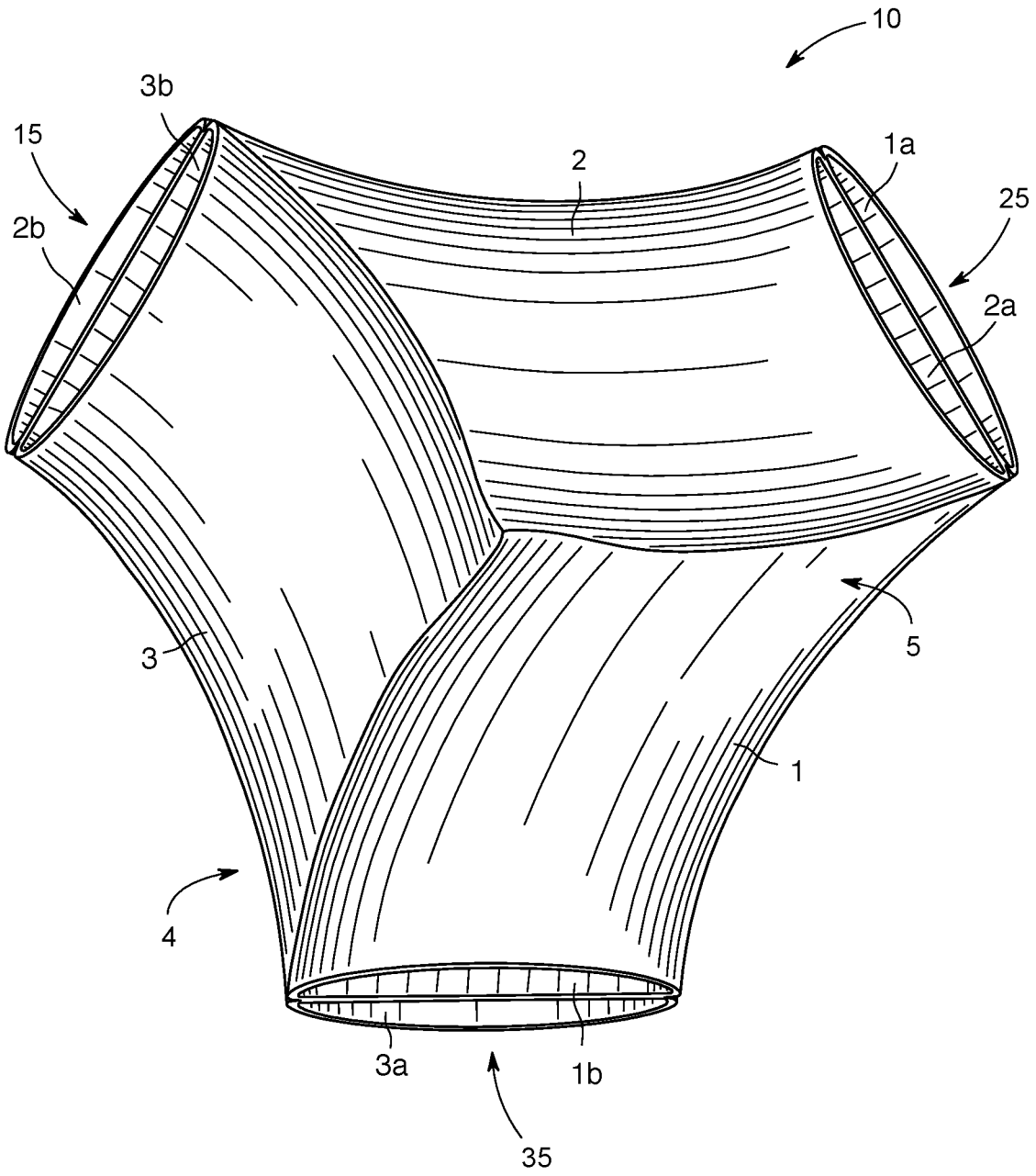
FIG. 1 is a back elevational view of the device.

The following description refers to the accompanying drawings. Whenever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. The proper scope of the invention is defined by the appended claims, and therefore the following detailed description does not limit the invention but serves to give further description to the claims.

The invention is a device which guides a user through the creation of a personalized, modular tie accessory. Briefly, the device comprises a 3-dimensional manifold [10] generally in the shape of a tie knot, for receiving a first tie or fabric wrapped around the exterior to form the tie knot, wherein the manifold [10] is comprised of three interlocked tubes [1;2;3] for receiving a second tie to form the loop and hanging ends. Reference will be made to FIG. 1, which is a back elevational view of the preferred embodiment of the device.

The manifold [10] is comprised of three tubes [1; 2; 3] that are interwoven with their ends aligned to create a bottom opening [35], a right-side opening [25] and a left-side opening [15], wherein each said opening is comprised of the adjoined ends of two of the tubes. More particularly, the right-side opening [25] is comprised of the first end [la] of the first tube [1] and the first end [2*a*] of the second tube [2]; the bottom opening [35] is comprised of the second end [1*b*] of the first tube [1] and the first end [3*a*] of the third tube [3]; and the left-side opening [15] is comprised of the second end [2*b*] of the second tube [2] and the second end [3*b*] of the third tube [3].

Figure 3:
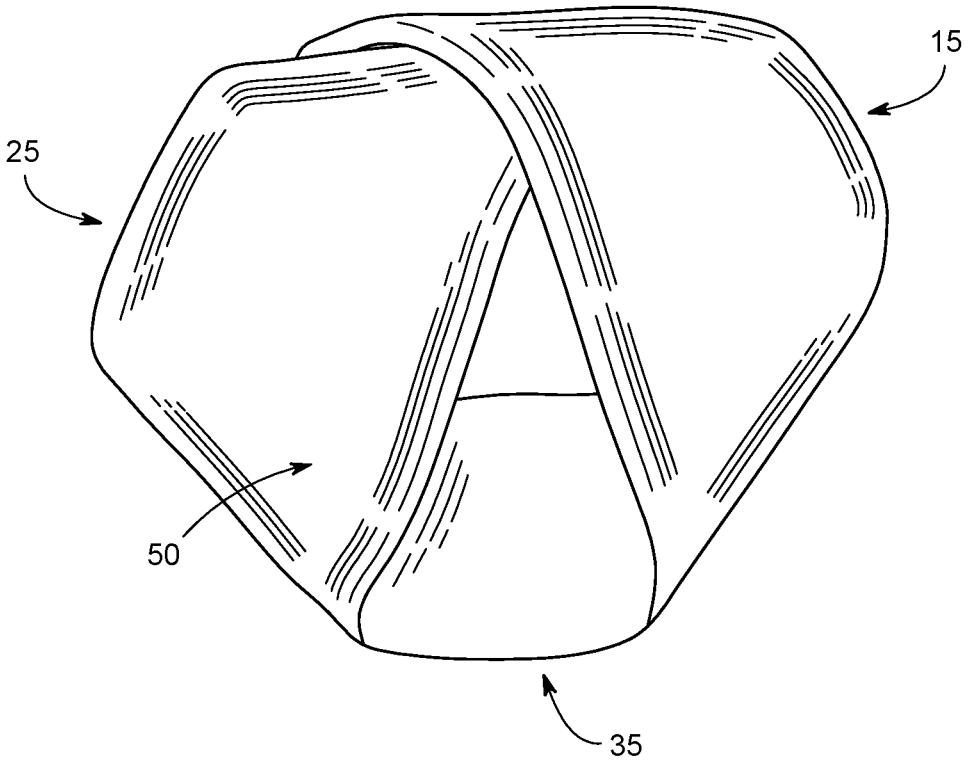
FIG. 3 depicts the device in use with a fabric or first tie secured around the device to form the tie knot.
Figure 8:
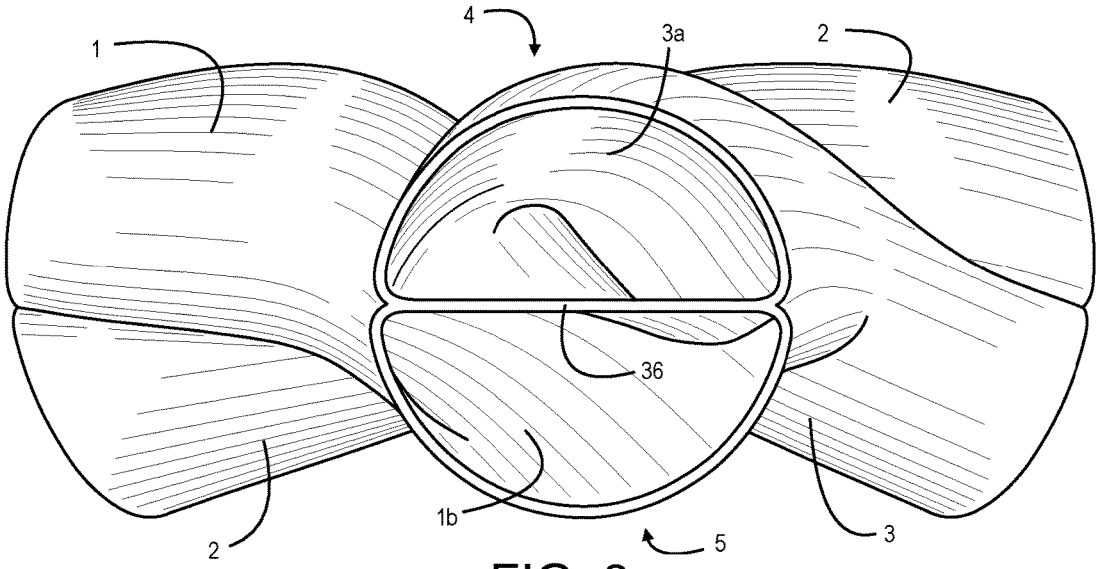
FIG. 8 is a bottom view of the device.
Figure 9:
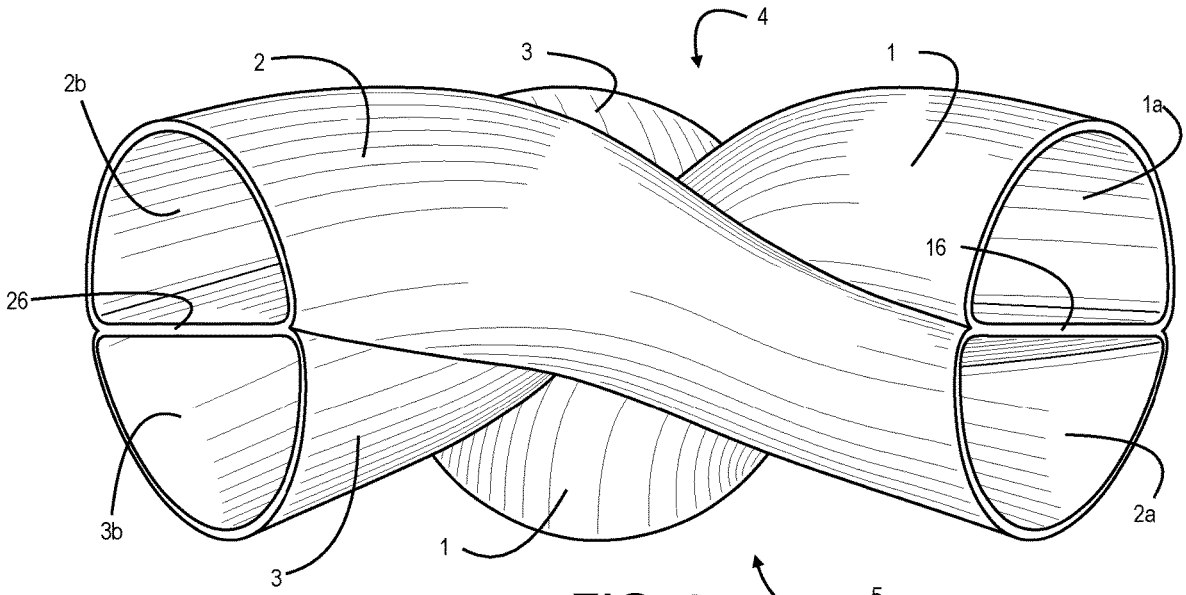
FIG. 9 is a top view of the device.

In the preferred embodiment, the front [4] of the manifold is convex while the back [5] of the manifold is concave. Tube ends [1*b*; 2*a*; 3*b*] are openings on the back side of the manifold, i.e. the side of the manifold facing the collar when worn, while openings [la; 2*b*; 3*a*] are openings on the front side of the manifold, i.e. the side of the manifold facing away from the body. The back elevational view of the preferred embodiment is shown in FIG. 1 so that the openings [15;25;35] of the manifold [10] can be clearly seen and described, since the openings [15;25;35] would be less visible in a front elevational view of the preferred embodiment due to the slight curvature. This slight curvature, also visible in FIGS. 8 and 9 bottom and top views, causes the completed tie knot to appear to fit more aesthetically against the collar, and also conceals the openings [15;25;35] when the tie knot is worn (as shown, for example, in FIG. 3). In other embodiments, however, the front [4] and back [5] of the manifold may be identical, and different curvatures may be possible for different tie knot effects, without departing from the spirit of the invention.

The manifold [10] can therefore be used to create a modular, personalizable tie as follows: a strip of fabric can be attached and wrapped around the manifold to form a necktie knot. The fabric may be any strip of fabric that a user desires to form the tie knot of the modular tie, including a first necktie from which one end has been cut to eliminate extra material. The fabric is wrapped around the manifold [10] to form a decorative tie knot as desired, resulting in a tie knot [50] such as the example shown in FIG. 3, which depicts an aperture knot. Different techniques may be applied to create tie knots of different styles, such the Eldredge knot depicted in FIG. 7. As will be further described below, the geometry of the manifold [10] may also be adjusted in order to provide different tie knot shapes. For instance, thicker, looser or more compact knots may also be desired. There is no restriction in the way the tie knot can be wrapped around the manifold and constructed, such that any type of decorative knots may be formed. These decorative, modular tie knots can be sold pre-wrapped, but any user can create the tie knot using the manifold [10].

Figure 4:
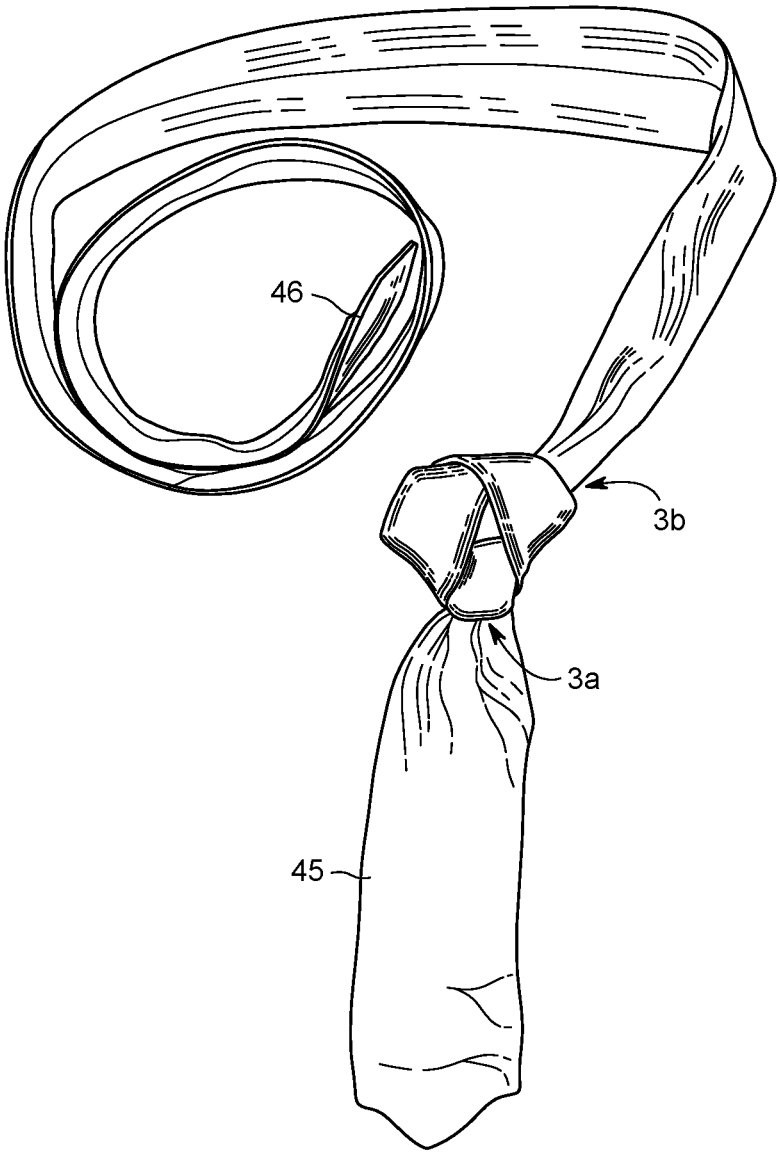
FIG. 4 depicts the device in use in which a necktie has been threaded through the bottom and right-side opening.
Figure 5:
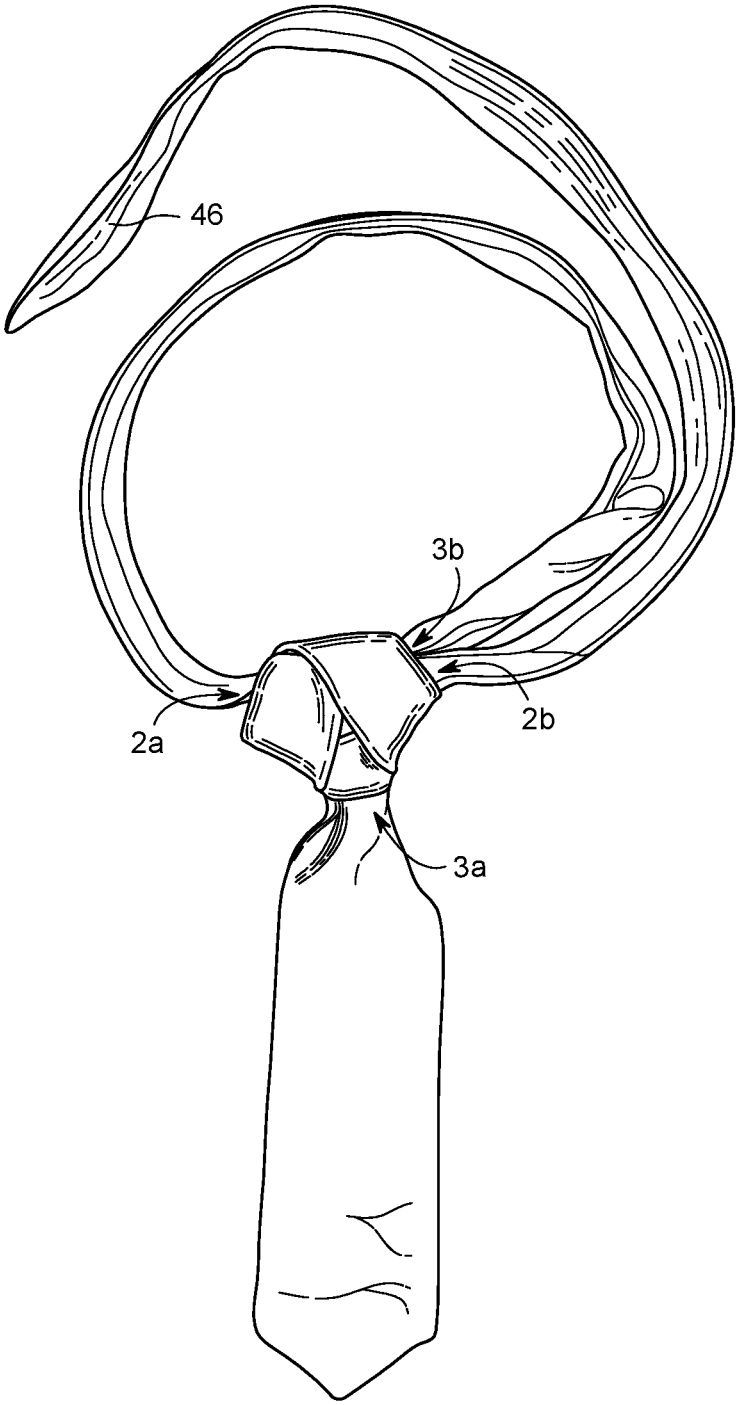
FIG. 5 depicts the device in use in which a necktie has been threaded through the left-side to the right-side opening.
Figure 6:
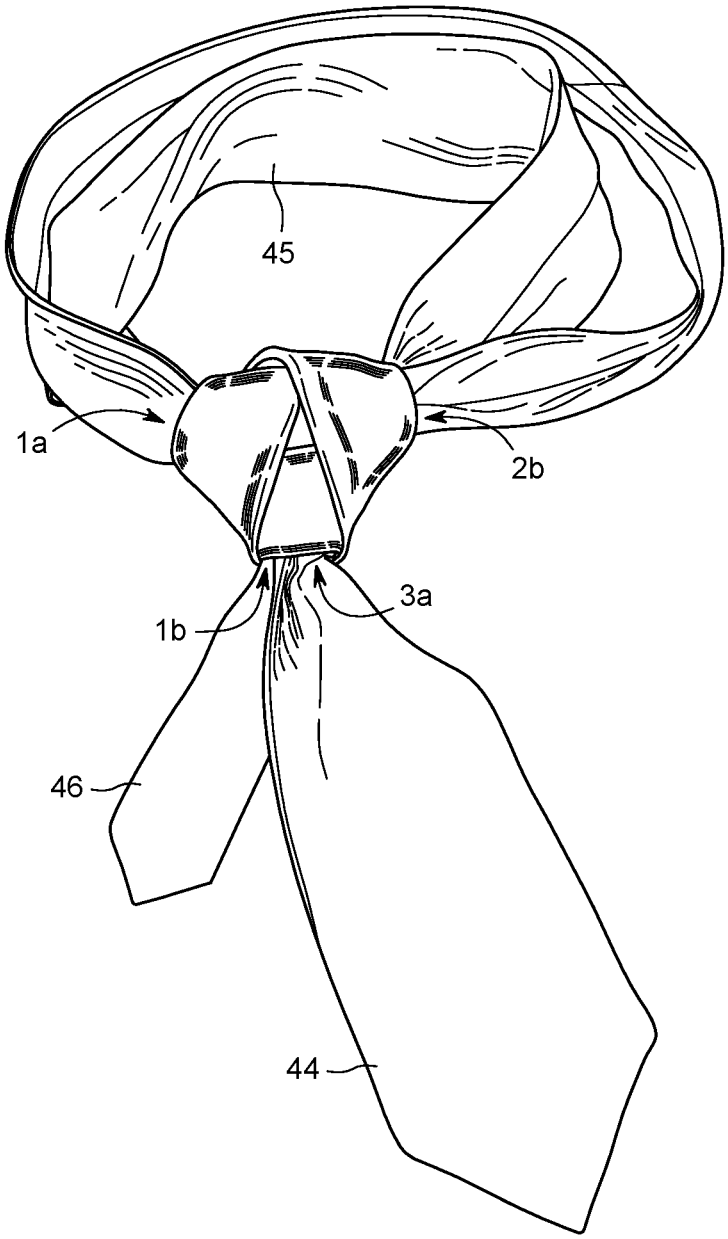
FIG. 6 depicts the device in use in which a necktie has been threaded through the left-side opening to the bottom opening.

The manifold [10] forms the base through which a necktie can be threaded to create the personalized tie. The skinny end [46] of necktie [45] is inserted into third tube [3] via its first end [3*a*] so it emerges through its second end [3*b*], as shown in FIG. 4. Next, end [46] is inserted into the second tube [2] via its first end [2*a*] so it emerges through its second end [2*b*], forming a first loop, as shown in FIG. 5. Finally, end [46] is inserted into first tube [1] via its first end [la] so it emerges through its second end [1*b*], forming a second loop, as shown in FIG. 6. The completed tie loops can be placed around the neck, adjusted and worn.

Figure 7:
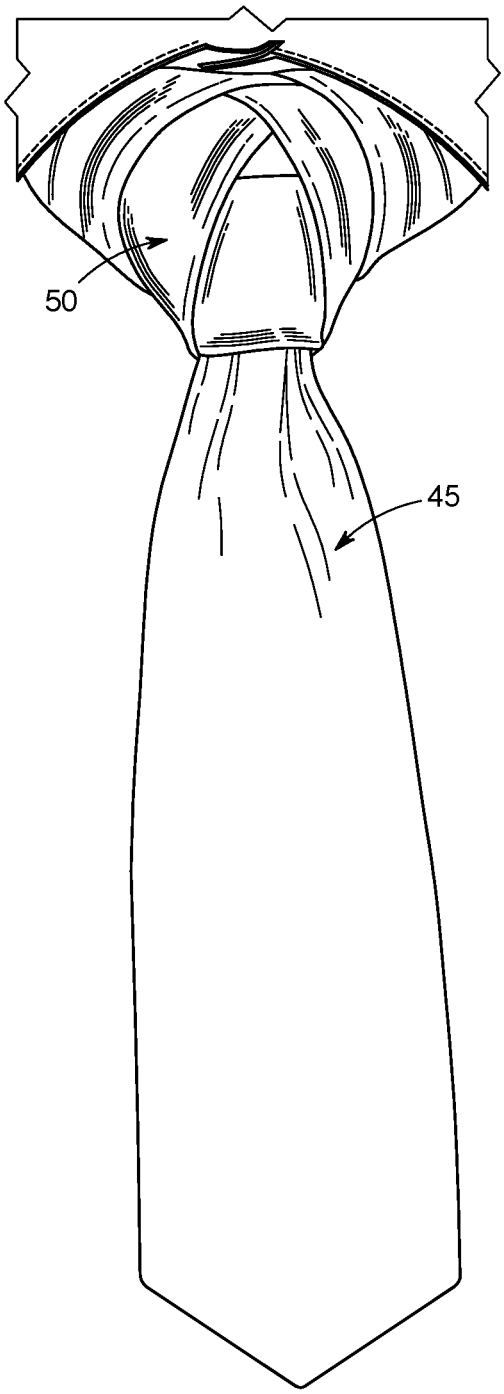
FIG. 7 depicts an example of the device in use in which a two-toned tie has been completed for wearing.

An example of a completed modular tie being worn is depicted in FIG. 7. The decorative tie knot [50] depicted in FIG. 7 is an Eldredge knot, as an example of the variety of styles of tie knots that can be created using the manifold [10]. Different tie knots can be interchanged with different neckties [45] to personalize the wearer's style. The wearer may even desire to pair the tie knot with different color neckties for a two-toned tie style.

The lengths of the tubes and therefore the proportions of the manifold may be adjusted to form the base of narrow or wide tie knots, i.e. the first, second and third tubes [1;2;3] may be of different sizes. For instance, where a longer knot is desired, the first and third tubes [1;3] may be longer than the second tube [2], said proportions being appropriate for a Van Wijk knot, for example. On the other hand, the first and third tubes [1;3] may alternatively be made shorter than the second tube [2], said proportions being appropriate for an Eldredge knot, for example. In the preferred embodiment shown in FIGS. 1-2, however, the first, second and third tubes [1;2;3] of the manifold [10] are of equal sizes; these proportions are appropriate for a Café knot. There are, however, no limitations on the types of knots that can be emulated using the manifold. Different sized manifolds may also be desired to accommodate large and small sizes, or adults and children. Furthermore, a wider or narrower angle between the first and third tubes [1;3] may be desired so that the knot may rest comfortably under different sizes or styles of collars. The manifold is simple to construct using 3D-printing or any other known techniques, and may be constructed of any solid material that may or may not be flexible, the best example of which is 3D printed nylon.

Figure 2:
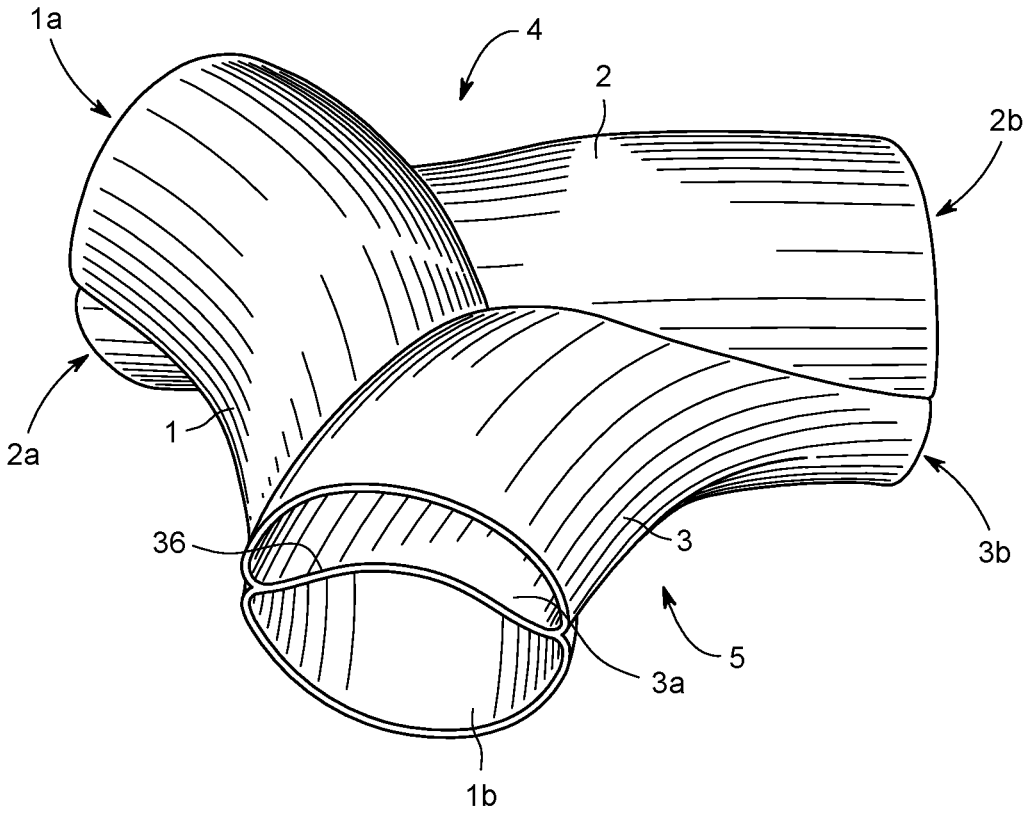
FIG. 2 is a front bottom perspective view of the device.

In the preferred embodiment depicted in FIGS. 1-2, the three tubes [1;2;3] have equal dimensions and are joined such that openings on the front and back of the manifold [10] are identical. The dimensions of the tubes and/or the way they are joined, however, may be varied without departing from the spirit of the invention. The tubes need not have the same dimensions throughout, and it is also noted that adjusting tube dimensions may result in changing the positions of opening cross walls [16; 26; 36]. Adjusting the tube dimensions may be desirable for a variety of purposes, including aesthetic reasons, or to make it easier for a user to thread the necktie through the manifold. For example, in order that the larger tie end [44] appears with a more natural and aesthetically pleasing curvature, cross wall [36] may be adjusted such that opening [3*a*] is concave at the cross wall and opening [1*b*] is convex at the cross wall. As another example, one or more cross walls at the opening may be constructed with a curved edge, as shown in FIG. 2 cross wall [36]. As another example, the thickness of any tube may be varied at any location in the tube to change the dimensions of the tubes or the cross wall locations. Any of the aforementioned variations may be desirable to facilitate threading different types of ties, such as thicker or wider ties.

The invention claimed is:

1. A necktie accessory for creating a modular tie knot, the accessory comprising:

[a.] a first tube having a first end and a second end, a second tube having a first end and a second end, and a third tube having a first end and a second end, said three tubes attached together to form a manifold, said manifold having a front side and a back side, wherein the three tubes are attached together as follows:

[i.] the first end of the first tube and the first end of the second tube are adjoined to form a right-side opening, the area of their joinder forming a right-side cross wall, wherein the first end of the first tube is on the front side of the manifold and the first end of the second tube is on the back side of the manifold;

[ii.] the second end of the second tube and the second end of the third tube are adjoined to form a left-side opening, the area of their joinder forming a left-side cross wall, wherein the second end of the second tube is on the front side of the manifold and the second end of the third tube is on the back side of the manifold; and

[iii.] the first end of the third tube and the second end of the first tube are adjoined to form a bottom opening, the area of their joinder forming a bottom cross wall, wherein the first end of the third tube is on the front side of the manifold and the second end of the first tube is on the back side of the manifold.

2. The necktie accessory of claim 1 wherein the front side of the manifold is convex and the back side of the manifold is concave.

3. The necktie accessory of claim 1 wherein the edge of at least one of the right-side, left-side or bottom cross walls is curved inward toward the interior of the manifold.

4. The necktie accessory of claim 2 wherein the edge of at least one of the right-side, left-side or bottom cross walls is curved inward toward the interior of the manifold.

5. The necktie accessory of claim 1 wherein the bottom cross wall is adjusted to be concave with respect to the first end of the third tube and convex with respect to the second end of the first tube.

6. The necktie accessory of claim 2 wherein the bottom cross wall is adjusted to be concave with respect to the first end of the third tube and convex with respect to the second end of the first tube.

7. The necktie accessory of claim 3 wherein the bottom cross wall is adjusted to be concave with respect to the first end of the third tube and convex with respect to the second end of the first tube.

8. The necktie accessory of claim 4 wherein the bottom cross wall is adjusted to be concave with respect to the first end of the third tube and convex with respect to the second end of the first tube.

9. The necktie accessory of claim 2 wherein the second tube is shorter than the first and third tubes, which are of the same length.

10. The necktie accessory of claim 2 wherein the second tube is longer than the first and third tubes, which are of the same length.

11. The necktie accessory of claim 4 wherein the second tube is shorter than the first and third tubes, which are of the same length.

12. The necktie accessory of claim 4 wherein the second tube is longer than the first and third tubes, which are of the same length.

13. The necktie accessory of claim 5 wherein the second tube is shorter than the first and third tubes, which are of the same length.

14. The necktie accessory of claim 5 wherein the second tube is longer than the first and third tubes, which are of the same length.

15. The necktie accessory of claim 6 wherein the second tube is shorter than the first and third tubes, which are of the same length.

16. The necktie accessory of claim 6 wherein the second tube is longer than the first and third tubes, which are of the same length.

17. The necktie accessory of claim 7 wherein the second tube is shorter than the first and third tubes, which are of the same length.

18. The necktie accessory of claim 7 wherein the second tube is longer than the first and third tubes, which are of the same length.

19. The necktie accessory of claim 8 wherein the second tube is shorter than the first and third tubes, which are of the same length.

20. The necktie accessory of claim 8 wherein the second tube is longer than the first and third tubes, which are of the same length.

* * * * *